US005839241A

United States Patent [19]

Cacossa et al.

[11] Patent Number: 5,839,241

[45] Date of Patent: Nov. 24, 1998

[54] REINFORCED WALL PATCH

[76] Inventors: Frank G. Cacossa, 93 Martin Rd., Livingston, N.J. 07039; Thomas E. Heide, 1873 Olive St., Piscataway, N.J. 08854

[21] Appl. No.: 861,380

[22] Filed: May 21, 1997

Related U.S. Application Data

[60] Provisional application No. 60/025,009 Aug. 21, 1996.

[51] Int. Cl.[6] ..... E04F 19/02; E04F 13/06

[52] U.S. Cl. ..... 52/255; 52/287.1; 52/514

[58] Field of Search ..... 52/254, 255, 287.1, 52/514, 514.5

[56] References Cited

U.S. PATENT DOCUMENTS 3,109,207 11/1963 Cooper ..... 52/255
4,835,925 6/1989 Hoffmann, Sr. ..... 52/287.1
5,422,886 6/1995 Iacobelli ..... 52/255
5,620,768 4/1997 Hoffmann, Sr. ..... 52/514 X

*Primary Examiner*—Carl D. Friedman
*Assistant Examiner*—Kevin D. Wilkens
*Attorney, Agent, or Firm*—Lerner, David, Littenberg, Krumholz & Mentlik

[57] ABSTRACT

The present invention is a reinforced wall patch comprising a sheet of mesh material, such as fiberglass mesh, and a sheet of fibrous material, such as paper, attached to the sheet of mesh material whereby the bendability of the mesh material is enhanced. Thus, the present wall patch may be effectively used as a cornerpiece in applications which require enhanced flexibility. A sheet of protective material may be attached to the surface of the mesh material in such a manner so that the mesh material is arranged between the fibrous material and the protective material.

18 Claims, 2 Drawing Sheets

REINFORCED WALL PATCH

CROSS-REFERENCE TO RELATED APPLICATION

Priority under 35 U.S.C. §119(e) is claimed on U.S. application Ser. No. 60/025,009.

FIELD OF THE INVENTION

The present invention relates to cornerpieces to protect various corners such as corners on dry wall, doors and the like. The present invention also relates to tape for use when spackling wall joints or damaged areas under repair.

BACKGROUND OF THE INVENTION

Fiberglass mesh is commonly used as "tape" on flat portions of walls and ceilings to cover joints between dry wall sheets. For example, it is known in the art to place fiberglass mesh tape over joints between sheet rock sheets (i.e., dry wall sheets) and to subsequently apply a joint compound (e.g., spackle) over the mesh tape. Notwithstanding this known use for mesh tape, it has several drawbacks which has precluded it from heretofore being used as a cornerpiece on dry wall, doors or other corners and angled areas. One particular drawback of fiberglass mesh tape which has precluded it from being used to tape corners is that fiberglass typically has too much inherent elasticity to permit proper creasing. Further, if fiberglass mesh tape is forced to become folded or creased, the inherent nature of prior art fiberglass is such that the tape is prone to cracking.

SUMMARY OF THE INVENTION

The present invention overcomes the foregoing drawbacks associated with prior art wall patches. As used herein, the term "wall patch" is intended to cover various substantially flat articles such as tape and the like which can be placed on walls, ceilings or doors to repair damaged areas or to create a desirable finished appearance. Thus, the term "wall patch" includes "tape" and "corner pieces" as well as other patch structures which can be used to repair or finish a wall surface at a corner joint or a central area as discussed hereinabove.

In accordance with a preferred embodiment, the wall patch of the present invention comprises a sheet of fiberglass mesh which has first and second opposing surfaces. A sheet of fibrous material, which may comprise paper, may be attached to the first surface of the sheet of fiberglass mesh. A sheet of protecting material, which may comprise metal or other substantially protective substrate, is attached to the second surface of the sheet of fiberglass mesh. According to this construction, the sheet of fiberglass mesh is arranged between the sheet of fibrous material and the sheet of protective material.

In a particularly preferred embodiment, the fibrous material may comprise paper and the protective material may comprise aluminum.

It is also contemplated that the sheet of protective material may comprise a pair of elongated sheets of protective material arranged parallel to each other and having a certain predetermined distance therebetween along the entire length thereof whereby the wall patch can be creased or folded between the pair of protective material sheets.

In another preferred embodiment, the wall patch may comprise a sheet of mesh material which is different from the fiberglass mesh. For example, the mesh material in accordance with this aspect of the present invention may comprise various polymeric materials, various fibrous materials, etc.

One aspect of the present invention refers to the placement of a fibrous material, such as paper, behind mesh material. This arrangement is particularly useful as the paper reinforces the mesh material and adds durability which prevents cracking of the mesh material during folding or creasing. In a preferred embodiment, the mesh material may comprise fiberglass. This aspect of the present invention permits a combination of such fiberglass mesh and paper to be used as a cornerpiece which can bend without cracking. It is also contemplated that the wall patch of the present invention can be used to repair central areas of a wall which are remote from a corner. For example, the present wall patch can simply be placed over a hole in a sheet rock wall and spackle material can then be applied thereto. In accordance with this embodiment of the present invention, cracking of the fiberglass mesh is not usually a problem.

In order to provide desired reinforcement to the present wall patch, two or more spaced-apart elongated strips of protective material can also be attached to the fiberglass mesh. In a preferred embodiment, the protective material may comprise aluminum strips which extend parallel to each other and are separated by a sufficient distance to permit creasing and bending of the cornerpiece for placement on the corner of a wall. The elongated strips of aluminum, or other protective material, are useful to prevent damage to the corners of a wall when the cornerpiece is used on exposed corners that are subject to impact.

In another preferred embodiment, the present invention includes the use of rivets which connect the aluminum strips to the paper to thereby create a sandwich structure in which the fiberglass mesh is interposed between the aluminum and the paper. It should be appreciated that in alternate embodiments of the present invention, various types of metal strips, or other protective materials such as polymeric strips and the like, may be used in place of aluminum. Further, other mesh materials can be used in place of fiberglass such as polymers, fibrous materials, etc. An advantage of using fiberglass is that it is known to meet various fire code requirements.

The fiberglass mesh may include a contact adhesive which is sufficient to retain the present invention on a vertical surface prior to the application of joint compound (i.e., spackle).

It is an object of the present invention to provide a durable wall patch which is particularly effective but inexpensive to manufacture.

These and other objects, features and advantages of the present invention will be more readily understood when considered in conjunction with the following detailed description of the preferred embodiments and the drawings.

DETAILED DESCRIPTION OF THE PREFERRED EMBODIMENTS

Figure 1:
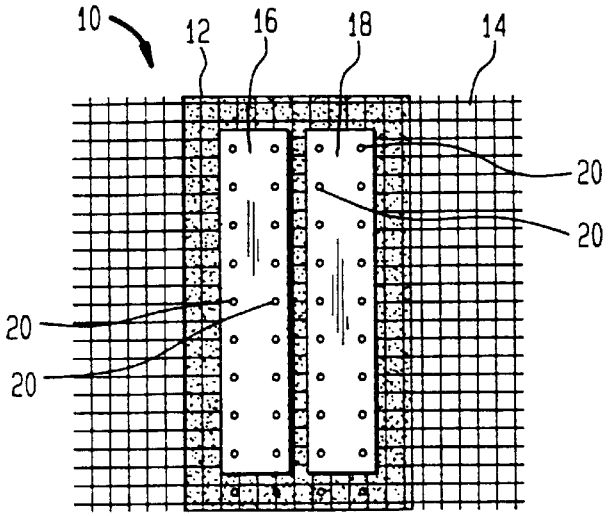
FIG. 1 is a rear view of the present invention.
Figure 2:
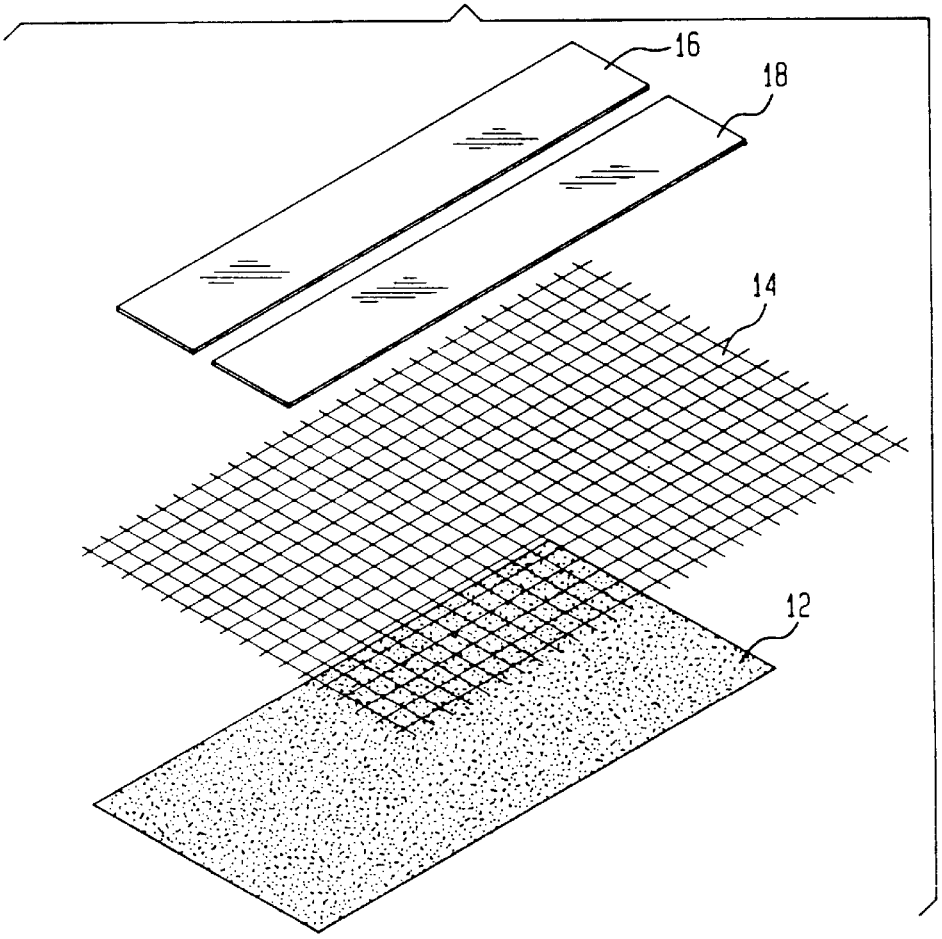
FIG. 2 is an exploded view of the present invention.
Figure 3:
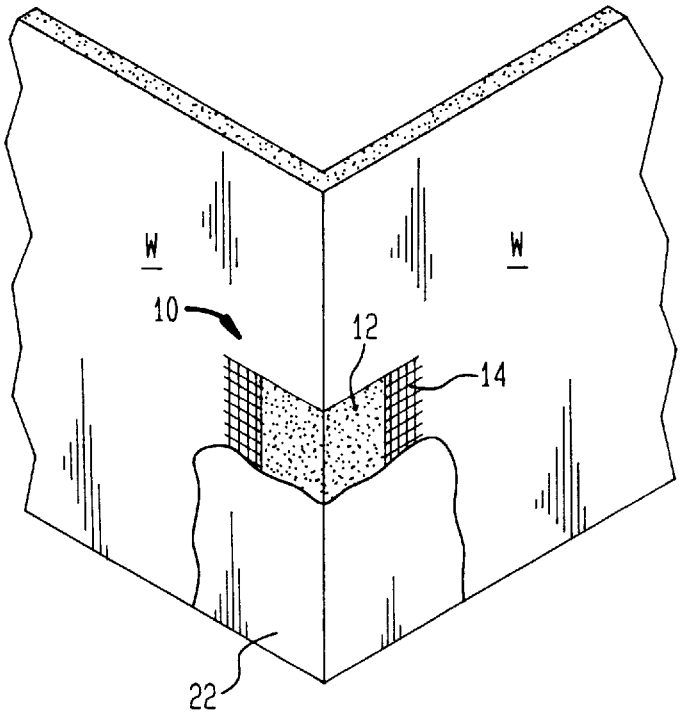
FIG. 3 is a prospective view of the present invention in assembled position as a cornerpiece on a wall partially embedded beneath spackle.

As shown in FIGS. 1–3, the present invention relates to reinforced mesh tape which can be used as a reinforcement cornerpiece or simply to cover joints between dry wall sheets and the like. With reference to FIGS. 1–3, the present reinforced mesh tape assembly is designated by reference numeral 10. The mesh tape assembly 10 shown in FIGS. 1 and 2 comprises a sheet of fibrous material 12, such as paper, which is arranged on a first surface of a sheet of fiberglass mesh 14. The fiberglass mesh 14 may be coated on an opposing second surface with a contact adhesive. Suitable contact adhesives are well known in the art and have been used in conjunction with mesh patches which are not reinforced.

A pair of aluminum sheets 16 and 18 are arranged on the second surface of the fiberglass mesh 14 at a location opposing paper sheet 12. As best shown in FIG. 1, a plurality of rivets 20 may be used to hold the present reinforced mesh tape assembly 10 together. In particular, the rivets 20 attach the aluminum sheets 16 and 18 to the paper sheet 12 and the interposed fiberglass mesh sheet 14. Thus, a sandwich structure is formed in which the fiberglass mesh sheet 14 is securely arranged between the aluminum sheets 16 and 18 and a sheet of paper 12. It should be appreciated that the mesh tape assembly 10 may be secured together by various means other than rivets 20. For example, adhesive material may be disposed throughout the mesh tape assembly 10 so that the paper sheet 12, the fiberglass mesh sheet 14 and the aluminum sheets 16 and 18 are adhered together as an integral assembly.

In the preferred embodiment of the present invention shown in FIG. 1, the strips of aluminum 16 and 18 are arranged parallel to each other and are spaced apart by a small distance (not designed by a reference numeral) so that the mesh tape assembly 10 can be creased and placed around a corner as shown in FIG. 3.

FIG. 2 illustrates the three main components of the present invention in an exploded view. In particular, the aluminum sheets 16 and 18 (collectively considered one of the main components of the mesh tape assembly), which are the rear-most components, are shown suspended above the fiberglass mesh sheet 14, while the sheet of paper 12 is shown suspended below the fiberglass mesh sheet 14.

It should also be appreciated that although the preferred embodiment of the present invention shown in FIGS. 1–3 include the sandwich structure of the three main components discussed above, other embodiments of the present invention may comprise only two components. For example, if the present invention is intended to be used to facilitate the smooth appearance of corners where corners are not prone to impact, reinforcing aluminum sheets 16 and 18 may be eliminated. The combination of paper sheet 12 and the adjacent fiberglass mesh sheet 14 will permit the fiberglass mesh to bend around corners as required without cracking.

In another preferred embodiment, the present invention may comprise separate strips of fiberglass mesh 14. In one such embodiment, first and second fiberglass mesh sheets 14 may be arranged parallel to each other so that adjacent separated edges thereof extend longitudinally between the aluminum sheets 16 and 18. This arrangement may facilitate folding of the mesh tape assembly 10 when used as a cornerpiece or on substantial angles.

When the present reinforced mesh tape is needed for impact protection as a cornerpiece, it is desirable for the aluminum sheets 16 and 18 to be placed immediately adjacent the corner to which the mesh tape assembly 10 will be attached. The second surface of the fiberglass mesh sheet 14 is preferably coated with a contact adhesive that will stick to the wall for a sufficient amount of time to permit a coat of spackle 22 to be applied thereto. Thus, in a preferred embodiment when in assembled position, the paper sheet 12 will be the furthest component from the wall mounted. This aspect of the present invention can be appreciated from FIG. 3, where it is shown as a cornerpiece.

In accordance with a preferred method of securing the present invention to the wall as a cornerpiece, it may be necessary to unroll a selected length of the present reinforced mesh tape assembly 10 and to thereafter cut the reinforced mesh tape assembly 10 to a desired length. The surface on which the present invention is to be applied should then be wiped with a damp cloth to be certain that the surface is free from dust and dirt. The present reinforced mesh tape 10 should then be creased at the center thereof between aluminum sheets 16 and 18. In particular, it is preferable for aluminum sheets 16 and 18 to be folded toward each other when performing the pre-creasing step. The present cornerpiece 10 may then be applied to the corner of a wall W as shown in FIG. 3 (or a door—not shown) or other desired corner. Pressure should be applied to the fiberglass mesh sheet 14 so that the cornerpiece 10 will temporarily remain in an attached upright position as shown in FIG. 3.

At this time, joint compound 22 should be applied horizontally with a trowel, or another appropriate compound applying tool, so that the entire surface of the cornerpiece 10 is covered with joint compound 22. This aspect of the present invention is conventional and is partially shown in FIG. 3. When the joint compound 22 has sufficiently dried, a finish coating can be applied as needed.

It should be appreciated that the aforementioned preferred embodiments of the present invention have been described by way of example only and are not intended to limit the particular materials or arrangement of such materials that can be used in accordance with the spirit and scope of the present invention which is defined by the following claims.

We claim:

1. A wall patch comprising:

a sheet of fiberglass mesh having first and second opposing surfaces;

a sheet of fibrous material attached to said first surface of said sheet of fiberglass mesh; and at least one sheet of protective material attached to said second surface of said sheet of fiberglass mesh, wherein said sheet of fiberglass mesh is arranged between said sheet of fibrous material and said at least one sheet of protective material thus forming a three layer structure which remains intact when installed on a wall surface.

2. The wall patch of claim 1 wherein said sheet of fibrous material comprises paper.

3. The wall patch of claim 1 wherein said protective material comprises metal.

4. The wall patch of claim 3 wherein said metal comprises aluminum.

5. The wall patch of claim 1 wherein said at least one sheet of protective material comprises a pair of elongated sheets of protective material arranged parallel to each other and having a predetermined distance therebetween along the entire length thereof whereby said wall patch can be creased or folded between said pair of protective material sheets.

6. The wall patch of claim 1 further comprising rivets extending through said sheets of mesh material, fibrous material and protective material to secure said material sheets together.

7. A wall patch comprising:

a sheet of mesh material having first and second opposing surfaces;

a sheet of fibrous material attached to said first surface of said sheet of mesh;

at least one sheet of protective material attached to said second surface of said sheet of mesh material, wherein said sheet of mesh material is arranged between said sheet of fibrous material and said at least one sheet of protective material; and a plurality of rivets extending through said sheets of mesh material, fibrous material and protective material to secure said material sheets together thus forming a three layer structure which remains intact when installed on a wall surface.

8. The wall patch of claim 7 wherein said sheet of fibrous material comprises paper.

9. The wall patch of claim 7 wherein said at least one sheet of protective material comprises a pair of elongated sheets of protective material arranged parallel to each other and having a predetermined distance therebetween along the entire length thereof whereby said wall patch can be creased or folded between said pair of protective material sheets.

10. The wall patch of claim 7 wherein said mesh material comprises fiberglass.

11. The wall patch of claim 7 wherein said protective material comprises metal.

12. The wall patch of claim 11 wherein said metal comprises aluminum.

13. The combination of a wall patch and a portion of a wall comprising:

a sheet of fiberglass mesh having first and second opposing surfaces;

a sheet of fibrous material attached to said first surface of said sheet of fiberglass mesh;

at least one sheet of protective material attached to said second surface of said sheet of fiberglass mesh, wherein said sheet of fiberglass mesh is arranged between said sheet of fibrous material and said at least one sheet of protective material thus forming a three layer structure; and a wall on which said three layer structure is arranged wherein said three layer structure remains intact when arranged on said wall.

14. The wall patch of claim 13 wherein said sheet of fibrous material comprises paper.

15. The wall patch of claim 13 wherein said at least one sheet of protective material comprises a pair of elongated sheets of protective material arranged parallel to each other and having a predetermined distance therebetween along the entire length thereof whereby said wall patch can be creased or folded between said pair of protective material sheets.

16. The wall patch of claim 13 further comprising rivets extending through said sheets of mesh material, fibrous material and protective material to secure said material sheets together.

17. The wall patch of claim 13 wherein said protective material comprises metal.

18. The wall patch of claim 17 wherein said metal comprises aluminum.

* * * * *

UNITED STATES PATENT AND TRADEMARK OFFICE

CERTIFICATE OF CORRECTION

PATENT NO. : 5,839,241

DATED : November 24, 1998

INVENTOR(S) : Cacossa et al.

It is certified that error appears in the above-identified patent and that said Letters Patent is hereby corrected as shown below:

In the Abstract, line 1, "The present invention is a reinforced wall patch comprising" should read --A reinforced wall patch comprises--.

Signed and Sealed this

Thirtieth Day of March, 1999

*Attest:*

Q. TODD DICKINSON

*Attesting Officer*

*Acting Commissioner of Patents and Trademarks*